US007182716B1

(12) United States Patent
Dawson

(10) Patent No.: US 7,182,716 B1
(45) Date of Patent: Feb. 27, 2007

(54) DUMBBELL WITH QUICK RELEASE BOLT

(76) Inventor: Matthew Fredric Dawson, 12701 66th Ave. SE., Snohomish, WA (US) 98296

( * ) Notice: Subject to any disclaimer, the term of this patent is extended or adjusted under 35 U.S.C. 154(b) by 230 days.

(21) Appl. No.: 10/665,665

(22) Filed: Sep. 19, 2003

(51) Int. Cl.
*A63B 21/00* (2006.01)
*A63B 21/075* (2006.01)

(52) U.S. Cl. ..... 482/108; 482/107; 482/104

(58) Field of Classification Search ..... 482/104–108, 482/50, 93; 403/316, 318, 261, 343
See application file for complete search history.

(56) References Cited

U.S. PATENT DOCUMENTS 675,314 A * 5/1901 Abenheim ..... 482/108
1,991,520 A * 2/1935 Postl ..... 482/108
3,488,051 A * 1/1970 Papistas-Scherer ..... 482/108
4,638,994 A * 1/1987 Gogarty ..... 482/107
4,738,446 A * 4/1988 Miles ..... 482/107
5,484,367 A * 1/1996 Martinez ..... 482/107

* cited by examiner

*Primary Examiner*—Jerome Donnelly
(74) *Attorney, Agent, or Firm*—Robert Samuel Smith

(57) ABSTRACT

A dumbbell including a tubular handle with a thread on the inside surface of the tube. A straight groove that cuts through the internal thread is also formed on the inside surface of the tubular handle. A stop plate is mounted on each end of the tubular handle. A pair of retainers are provided, each retainer being a shaft with a retainer plate on one end. Each shaft has a partial thread on its outside surface extending the length of the respective shaft.

A weight plate stack is mounted on the shaft and the shaft is securely inserted into the tubular handle by aligning the partial thread with the groove, sliding the shaft through openings in the weight plates into the tubular handle, then rotating each shaft to where the partial thread on the shaft engages the interior thread of the tubular handle.

8 Claims, 3 Drawing Sheets

DUMBBELL WITH QUICK RELEASE BOLT

This invention relates to dumbbells and particularly to a set of dumbbells that feature quick removal of plates with a quickly removable retaining bolt for changing the weight of the dumbbell as well as quickly changing to a longer retaining bolt for operating in a greater weight range when required.

BACK GROUND AND INFORMATION DISCOSURE

A dumbbell set is a pair of weights, one dumbbell in each hand, with which various exercises are performed such as curls, overhead press, supine press, and just about any motion holding the weight and moving the arms.

The original dumbbell, before the turn of the last century came into use consisting of a bar about twelve inches long to which were secured (plates) weights and collars for securing the weights. According to this arrangement, each bar had one pair of collars, centrally located on the bar and spaced from one another to permit grasping the center of the bar with one hand, with replaceable weights located on both ends of the bar held by retaining collars. The weights are typically cast iron plates having central apertures through which the handle is inserted. The weight is selected by choosing plates having appropriate thickness and diameter.

For safety sake, it is important that that the collars be secured very reliably to the bar. This is because the exercises generally involve swinging the dumbbells in a manner such that the weights could be flung off the handles in unpredictable directions if the collars become loose and separate during the exercise.

For many years, each collar has been a metal ring that slides onto the end of the bar. The ring is secured to the bar by a set bolt screwed through the metal ring against the bar. The head of the bolt is typically a "tee" that permits the user to apply greater torque when screwing the bolt against the bar to replace the plates.

This arrangement is not entirely reliable. The set bolts occasionally loosen regardless of the effort to tighten the bolt. At the least, this is an annoying interruption of the exercise.

Another persistent annoyance is the requirement to change the weight of each exercise. This requires loosening the bolt, sliding the ring off the handle, adding or subtracting the required weight, and then sliding and securing the ring back onto the handle.

Another problem with this design is the extension of the bar end and collar past the plates which interferes with the users ability to rest the dumbbells on his knees with the dumbbell handles oriented vertically.

U.S. Pat. No. 6,039,678 to Dawson discloses a dumbbell including a handle being a tube with an internal thread and a pair of fixed "stop" plates, one "stop" plate mounted on one end of the handle and the other "stop" plate mounted on the other end of the handle. A pair of threaded shafts is provided. Each shaft has a "retainer" plate on one end. The opposite end is screwed into a respective end of the threaded tube.

A stack of weight plates is mounted on each shaft. Each of the weight plates has a slot extending from a central opening to the edge of the plate so that the plate can "straddle" the tube. The weight plate is mounted on the respective shaft by unscrewing the shaft sufficiently (partially) out of the handle to permit sliding the shaft through the slot and then tightening the stack of weights between the respective retaining plate and stop plate. Each weight plate has a convex dimple in its surface which engages a concave dimple in a neighboring weight plate. When the stack is tightly clamped between the stop plate and retainer plate, the engaging dimples prevent slippage of the weight plate off the shaft. However, if the stack becomes loose while performing the exercise, the weight plate can slip off the handle.

Another problem is that, the stop plate is susceptible to being bent when the dumbbell is dropped so that the dimples no longer secure the stack to the handle.

SUMMARY OF THE INVENTION

It is an object of this invention to provide a dumbbell set that enables a user to change weight with greater speed and convenience than dumbbell sets of the present art.

It is another object that the dumbbell set be less susceptible to damage than sets of the present art.

It is another object to display the weight on the dumbbell.

This invention is directed toward a dumbbell comprising a handle being a tube about seven inches long. The interior surface of the tube is threaded. A "stop" plate, preferably rectangular, is concntrically and perpendicularly mounted opposite another stop plate on the other end of the tube.

Each stop plate has a centrally located aperture providing access for inserting a retainer shaft into each end of the tube.

Each retainer shaft has a (preferably square) retainer plate mounted concentrically and perpendicularly onto an end of the retainer shaft. The retainer shaft has a diameter selected to be a slideable fit into the tube.

The interior threaded surface of the tube has a straight groove extending from one end of the tube to the opposite end. The shaft has an external partial thread on one side extending along the length of the shaft. The thread has a width selected to permit sliding the shaft into the tube when the partial thread is aligned with the groove. After inserting the shaft into the tube, the disk handle is turned so that the partial thread on the shaft engages the thread on the interior surface of the tube.

The retainer is thereby locked into position relative to the handle. Weight plates mounted on the retainer shave are secured between the retainer plate and the stop plate.

The thickness of each weight plate is an integer multiple of the pitch of the partial thread (threads per inch). Therefore the user can immediately determine that the retainer is completely secured by a marking on the retainer plate indicating that the orientation of the retainer plate.

Indicia on surface of the shaft which is visible through a pair of apertures in the handle provide a convenient indication of the amount of weight on the dumbbell.

The foregoing summary has highlighted features, aspects and advantages of the present invention. The invention is further explained by the following description of what I presently believe to be the best mode for carrying out the invention illustrated by drawings to which are appended claims which define the scope of the invention.

BRIEF DESCRITION OF THE DRAWINGS

DESCRI[TION OF A BEST MODE

Figure 1:
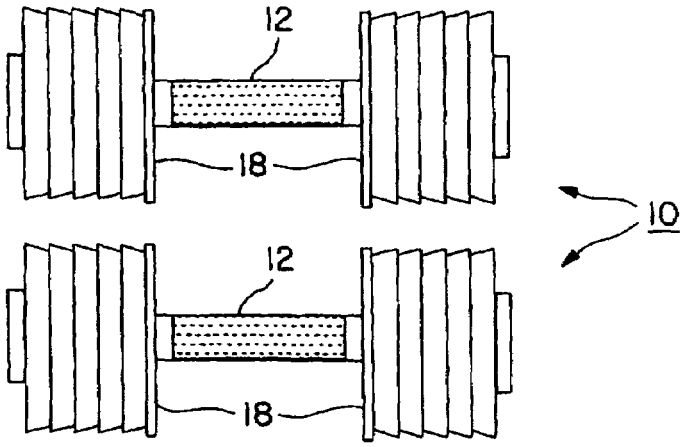
FIG. 1 shows the assembled dumbbell of this invention.
Figure 2:
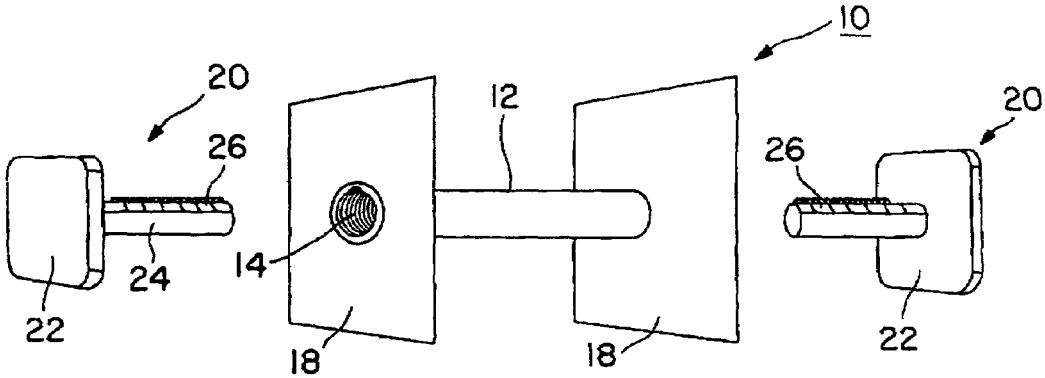
FIG. 2 shows an exploded view of the dumbbell.

Turning now to a discussion of the drawings, FIG. 1 shows a plan view of a pair of the dumbbells 10 of this invention. FIG. 2 is an exploded view of one dumbbell 10 shown in FIG. 1.

Figure 4A:
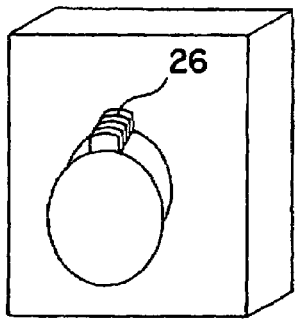
FIG. 4A is a perspective view showing an end of the retainer with the partial thread.
Figure 4B:
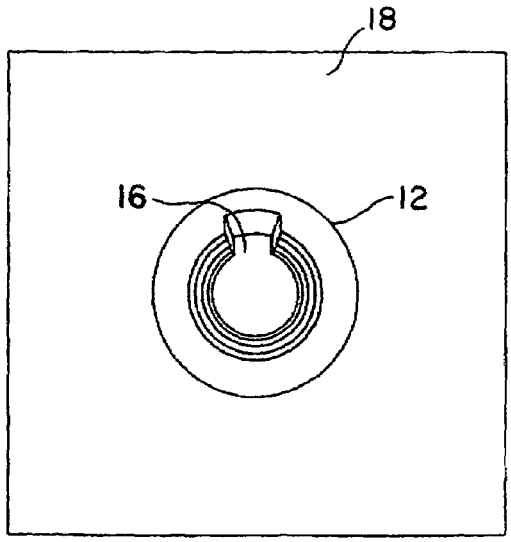
FIG. 4B is an end view of the dumbbell showing the stop plate, the groove and the thread on the interior surface of the tube.

There are shown a dumbbell handle being a tube 12 with a thread 14 on an internal surface that extends from one end of tube 12 to the other end. As shown to best advantage in the end view of the tube 12 in FIG. 4B, a groove 16 is formed in the internal surface of tube 12 that extends from one end of tube 12 to the other end.

A square "stop" plate 18 is mounted perpendicularly and concentrically on each end of the tube 12.

A retainer 20 is shown being a retainer plate 22 mounted concentrically and perpendicularly on one end of a shaft 24. The shaft 24 ha a partial thread 26 on one side of its surface extending the entire length of shaft 24.

Figure 5:
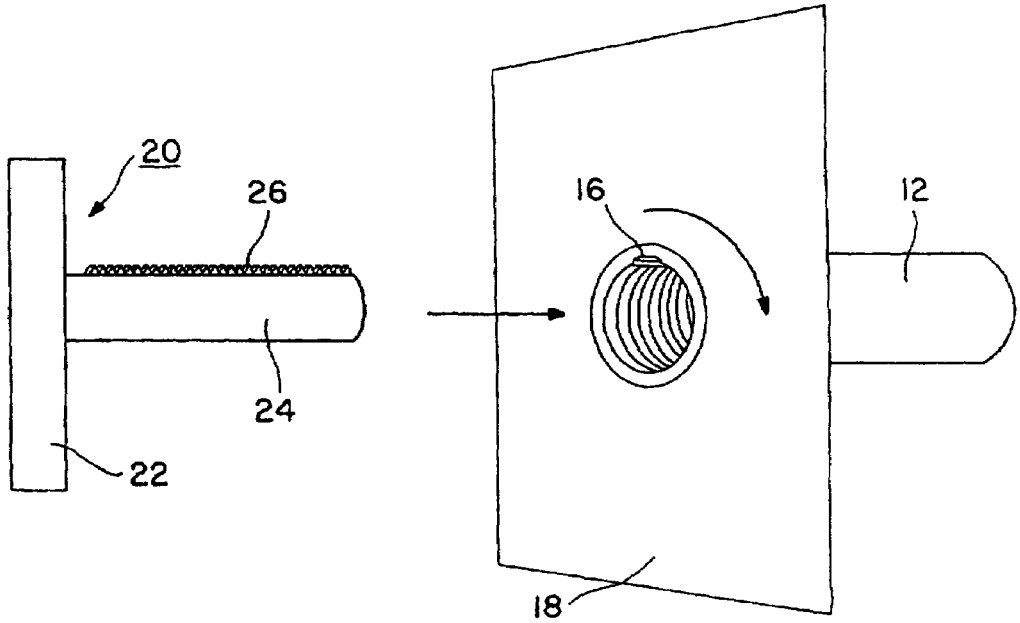
FIG. 5 shows the retainer poised for insertion into the tube.

As shown in FIG. 5, the shaft 24 with it partial thread 26 with groove 16 is poised for slideably telescoping the shaft 24 into the tube 12.

Figure 3:
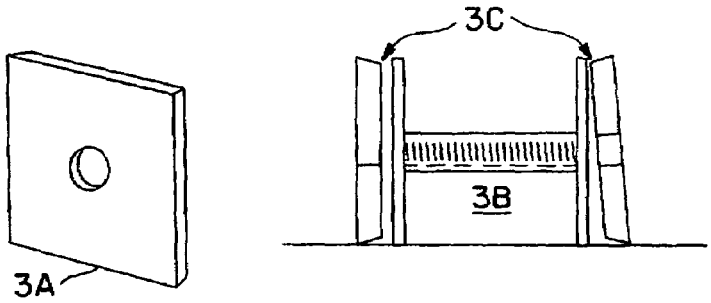
FIG. 3 shows the dumbbell plate with a slated edge.

Weight plates 30 (shown in FIG. 1 and to better advantage in FIG. 3) are preferably square and have a central aperture 32.

The stack of weight plates are mounted onto the dumbbell 10 by inserting the shaft 24 through aperture 32, aligning the partial thread 26 with groove 16 and then sliding the shaft 24 into the tube 12. The stack of weights is secured by rotating the retainer plate 22 so that the partial thread 26 on the shaft 24 engages the internal thread 16 of the tube 12 thereby securing the stack of weight plates 30 between the retainer plate 22 and stop plate 18.

The thickness of each weight plate 30 is a multiple integral of the pitch of the partial thread 26 so that, when the stack of weights is secured between the disk 22 and the stop plate 18, the disk will always have the same orientation regardless of how many weight plates 30 are mounted on the dumbbell 10.

Figure 6:
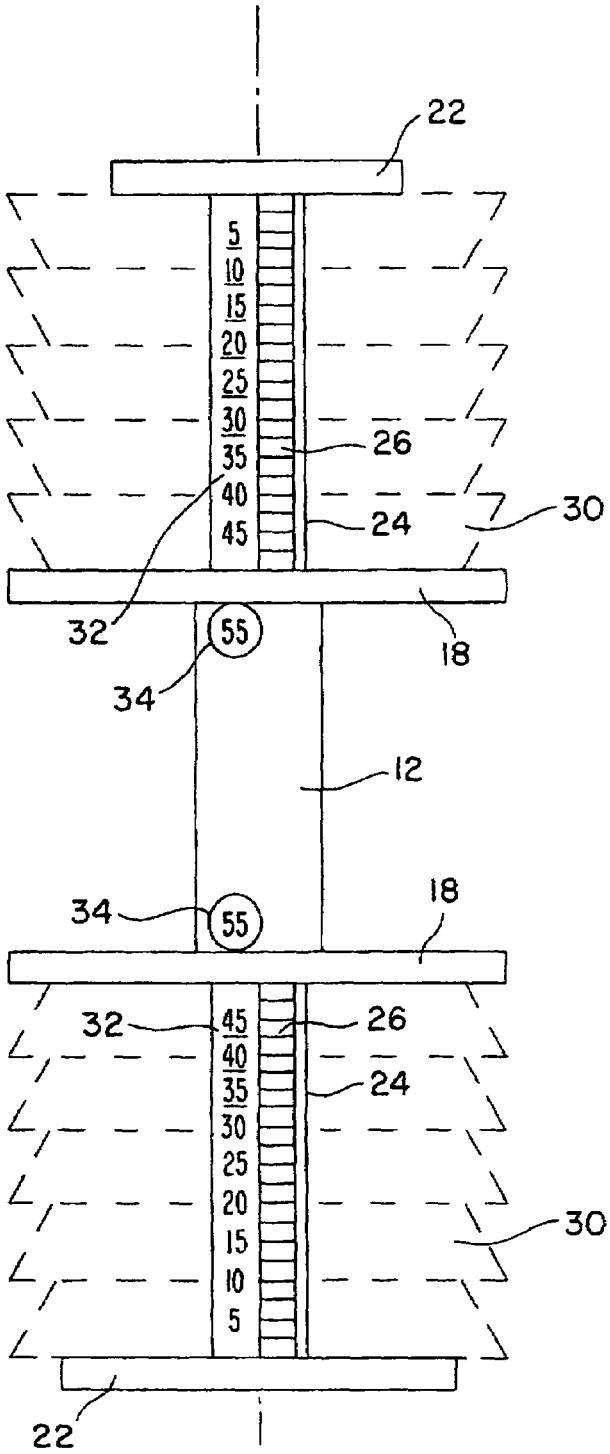
FIG. 6 shows the scale for indicating weight of the loaded dumbbell.

FIGS. 5 and 6 show an embodiment in which the edge 36 of each weight plate 30 is slanted.

The slanted 36 enables the user to lean the weight plates against the stop plate 18 to facilitate inserting the shaft into the tube 12.

FIG. 6 shows another embodiment according to which the user can instantaneously determine the weight of the stack on the dumbbell 10. The weight plates 30 are preferably square. Eaxh plate has a thickness equal to a multiple of a common thickness. The stack of weight plates 30 are shown in phantom in FIG. 6. A scale 32 is engraved on the shaft 24 and extends from one end to the other end of the shaft 24.

A hole 34 is formed in the tube 12 next to the stop plate and positioned so that, when the shaft is screwed into the tube sufficiently far to secure the weight plates 30 on the dumbbell 10, the weight of the dumhbell 10 with stack 30 is indicated by the scale number on the shaft 24 that is visible through the hole in the tube 12.

Figure 7:
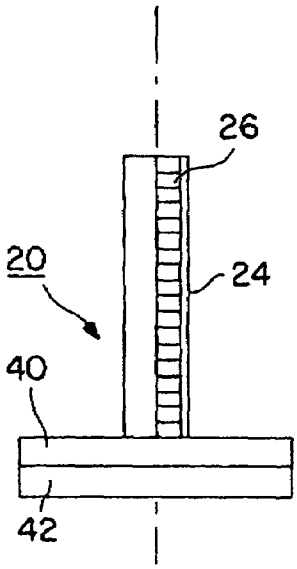
FIG. 7 shows a composite retainer plate.

FIG. 7 shows another embodiment in which the retainer plate on the retainer 20 is a composite of a thick rubber 40 laminated to a metal plate 42. The advantage of the rubber lamination 40 is that, when the retainer is screwed against the weight, the retainer is effectively "spring loaded" against the weight plate 30 so that loosening of the retainer plate 40 on the shaft 24 is prevented.

The dumbbell of this invention has several advantages over dumbbells of the prior art.

One advantage is the ease with which the weight is changed together with the security of complete engagement of the weight plate on the shaft.

Another advantage is the angled edges of each weight plate so that plates lean together and alignment of the holes through the plates is maintained. Insertion of the shaft through the aligned holes is facilitated for loading the plates onto the shaft.

Another advantage is convenient reading of the weight loaded on the handle through the aperture in the handle.

Another advantage provided by the rubber laminated retainer disk is that, by screwing the shaft to where the rubber on the retainer plate is forced against the stack of weights, the compressed rubber biases against loosening of the retainer plate.

Variations of this invention contemplated after reading the specification and studying the drawings may be contemplated that are within the scope of the invention.

For example, the entire surface of the retainer plate may be coated with a protective rubber coating. The rubber coating on the retainer plate reduces the danger associated with conventional dumbbells where the end of the handle extends out of the end of the stack of weights, The extending handle of the conventional dumbbell poses the danger of gouging the thigh of the user as he swings the dumbbell.

I therefore wish to define the scope of my invention by the appended claims.

I claim:

1. A dumbbell which comprises:

a handle tube having an interior surface;

said interior surface having an interior thread extending from one end to the opposite end of the handle tube;

a pair of stop plates;

each said stop plate having an aperture centrally located in each stop plate, respectively;

one of said stop plates mounted perpendicularly and concentrically on one end of said handle tube and another one of said stop plates mounted perpendicularly on an opposite end of said handle tube;

said interior surface having a straight groove extending from one end to an opposite end of said handle tube;

a pair of shafts, one shaft for each end of said handle tube;

each shaft having a retainer plate mounted perpendicularly and concentrically on one end of said each shaft;

each shaft having a linear partial thread mounted on a surface of said each shaft;

said partial thread extending from one end to an opposite end of said shaft, respectively;

one plurality of weight plates, each said weight plate having a centically located aperture to permit mounting said one plurality of weight plates on one said shaft by inserting said shaft through said apertures; and another plurality of weight plates, each said weight plate having a centically located aperture to permit mounting said another plurality of weight plates on another one of said pair of shafts by inserting said another one shaft through said apertures in said another plurality of weight plates;

each said shaft having a diameter and said partial thread having a pitch and width and said interior thread having a pitch and said groove having a width all arranged in operable combination to permit aligning said partial thread with said groove then telescoping each said shaft into an interior at respective ends of said tube, then turning said shaft to engage said partial thread on said shaft with said partial thread whereby said shaft is detachably secured to said handle tube and said one and another plurality of weights are secured between said one and another retainer and stop plates, respectively.

2. The dumbbell of claim 1 wherein all of said weight plates have a common thickness from one end of said aperture to an opposite end of said aperture.

3. The dumbbell of claim 2 wherein all of said weight plates have a thickness from one end of said aperture to an opposite end of said aperture equal to a multiple of a common thickness.

4. The dumbbell of claim 3 wherein said common thickness is a multiple of said pitch of said internal thread.

5. The dumbbell of claim 4 wherein:

each said shaft has a linear scale of indicia representing distance formed in a straight line from adjacent said respective retainer plate to an opposite end of said respective shaft;

said handle tube has a pair of openings in a side of said handle tube, one said opening proximal to one said stop plate and another said opening proximal to said other stop plate arranged in operable combination with said shafts screwed into respective ends of said handle tube to indicate an amount of weight of said pluralities of weight plates retained between said retainer plate and said respective stop plate.

6. The dumbbell of claim 1 wherein at least one of said retainer plates is a composite plate an elastomeric layer laminated to a metal plate.

7. The dumbbell of claim 3 wherein each said weight plate has an edge that is oblique to a centerline of said respective weight plate.

8. A dumbbell which comprises:

a handle tube having an interior surface:

said interior surface having an interior thread extending from one end to an opposite end of said handle tube;

a pair of stop plates;

each said stop plate having an aperture centrally located in said respective stop plate;

one of said stop plates mounted perpendicularly and concentrically on one end of said handle tube and another and another one of said stop plates mounted perpendicularly and concentrically on an opposite end of said handle tube;

said interior surface having a straight groove extending from one end to an opposite end of said handle tube;

a pair of shafts, one shaft for each end of said handle tube;

each shaft having a retainer plate mounted perpendicularly on one end of said respective shaft;

each shaft having a linear partial thread mounted on a surface of said shaft;

said partial thread extending from one end to an opposite end of said shaft;

said shaft having a diameter and said partial thread having a pitch and width and said handle tube having an interior diameter and said interior diameter thread having a pitch and said groove having a width all arranged in operable combination to permit aligning said partial thread with said groove then telescoping said shaft into an interior of said tube, then turning said shaft to engage sad partial thread on said shaft with said thread on said interior surface of said tube whereby said shaft is detachably secured in said handle tube;

one plurality of weight plates with apertures centrally located in each weight plate for mounting on one end of said handle tube by inserting one said shaft through said apertures and screwing into said one end of said handle tube; and another plurality of weight plates with apertures in each weight plate for mounting on another end of said handle tube by inserting another said shaft through said apertures and screwing into said another end of said handle tube;

each of said weight plates having a thickness that is a multiple of a common thickness from one end of said aperture to an opposite end of said aperture;

said common thickness being a multiple of said pitch of said internal thread;

each said shaft having a linear scale of indicia representing distance formed in a straight line from adjacent said respective retainer plate to an opposite end of said respective shaft;

said handle tube having a pair of side openings in a side of said handle tube, one said opening proximal to one stop plate and another said opening proximal to said other stop plate arranged in operable combination with said shafts screwed into respective ends of said handle tube to indicate an amount of weight of said pluralities of said weight plates retained between said retainer plate and said respective stop plate;

at least one of said retainer plates being a composite plate of and elastomeric layer laminated to a metal plate;

each said weight plate having an edge that is oblique to a centerline of said respective weight plate.

* * * * *